US005080355A

United States Patent [19]

Offutt

[11] Patent Number: 5,080,355

[45] Date of Patent: Jan. 14, 1992

[54] BASKETBALL HOOP STRUCTURE

[75] Inventor: James C. Offutt, Peoria, Ill.

[73] Assignee: Rimball Marketing and Development, Inc., Peoria, Ill.

[21] Appl. No.: 486,961

[22] Filed: Mar. 1, 1990

[51] Int. Cl.[5] ..... A63B 63/08

[52] U.S. Cl. ..... 273/1.5 R

[58] Field of Search ..... 273/1.5 R, 402; D21/201

[56] References Cited

U.S. PATENT DOCUMENTS

| | | | |
|---|---|---|---|
| D. 277,884 | 3/1985 | Offutt | D21/201 |
| 1,024,997 | 4/1912 | Longworth | 248/220.1 |
| 1,053,850 | 2/1913 | Milks | 273/1.5 R X |
| 3,414,262 | 12/1968 | Lounsbury | 273/1.5 R |
| 3,599,976 | 8/1971 | Krajac | 273/1.5 R X |
| 3,702,700 | 11/1972 | Burke | 273/1.5 R |
| 4,036,494 | 7/1977 | Hayes | 273/1.5 R |
| 4,300,764 | 11/1981 | Burke | 273/1.5 R |
| 4,657,249 | 4/1987 | Offutt | 273/1.5 R |

FOREIGN PATENT DOCUMENTS

| | | | |
|---|---|---|---|
| 1313021 | 11/1962 | France | 273/1.5 R |

OTHER PUBLICATIONS

Argo Industries Advertising Circular 3-1965 Water Fun #532 Delux Aluminum Floating Basketball Game.

*Primary Examiner*—Paul E. Shapiro

*Attorney, Agent, or Firm*—McAndrews, Held & Malloy, Ltd.

[57] ABSTRACT

A corner basketball hoop support facilitates playing of basketball in a small indoor area. In particular, a basketball hoop device is comprised of a three-sided triangular rim and leg members. The legs members are attached to the triangular rim at their lower ends and to a basketball rim above the triangular rim at their upper ends. Also an inverted J-shaped rod, a backboard, a bracket, and straight support members form a basketball hoop device. The inverted J-shaped rod has a longer portion, secured to the corner of a room, while the shorter portion extends out from the corner and is secured to the posterior surface of a backboard. The backboard also has outer edges which are wedged securely against the corner walls for support. A bracket with supporting members is attached to the anterior surface of the backboard to support a basketball hoop.

4 Claims, 2 Drawing Sheets

Fig. 1
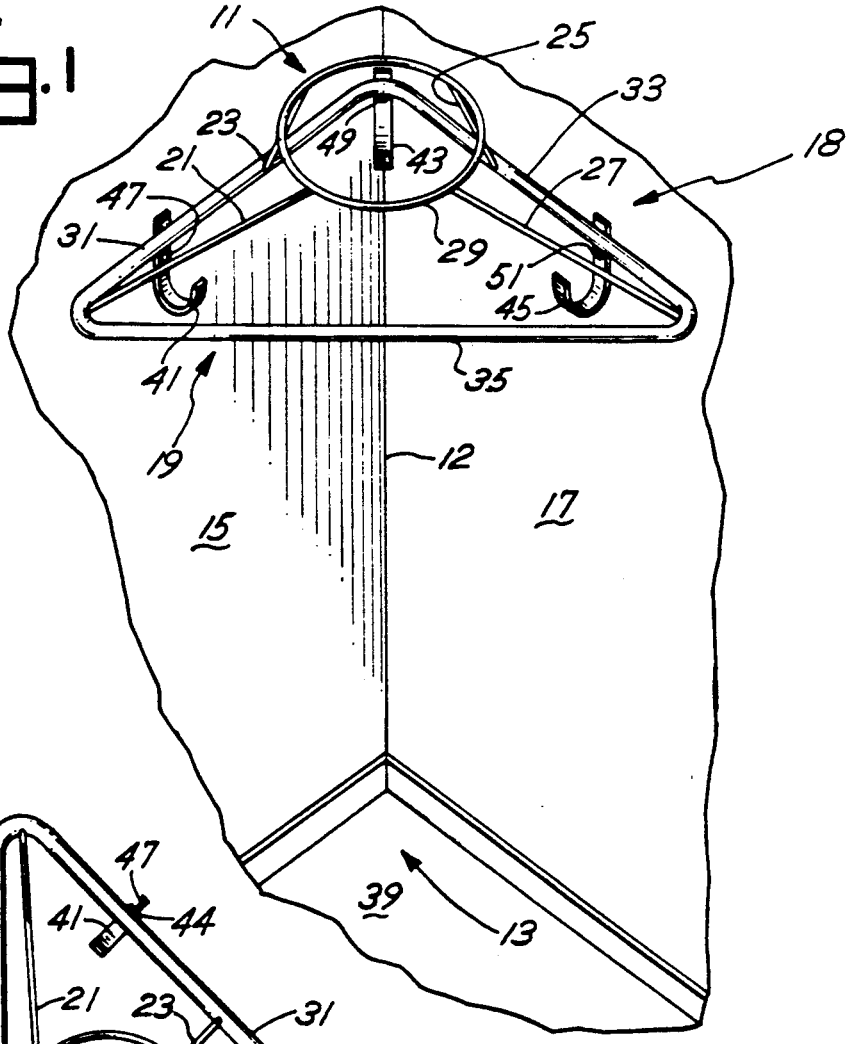
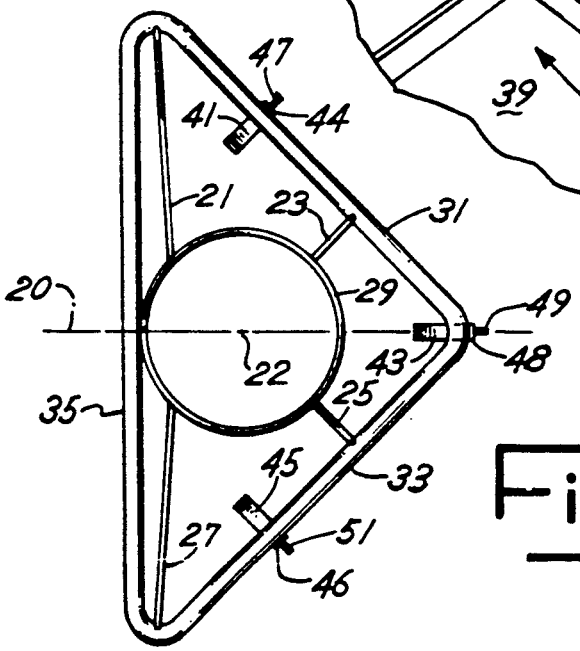
Fig. 2
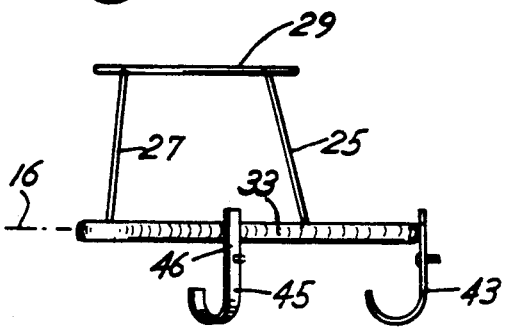
Fig. 3

Fig.4
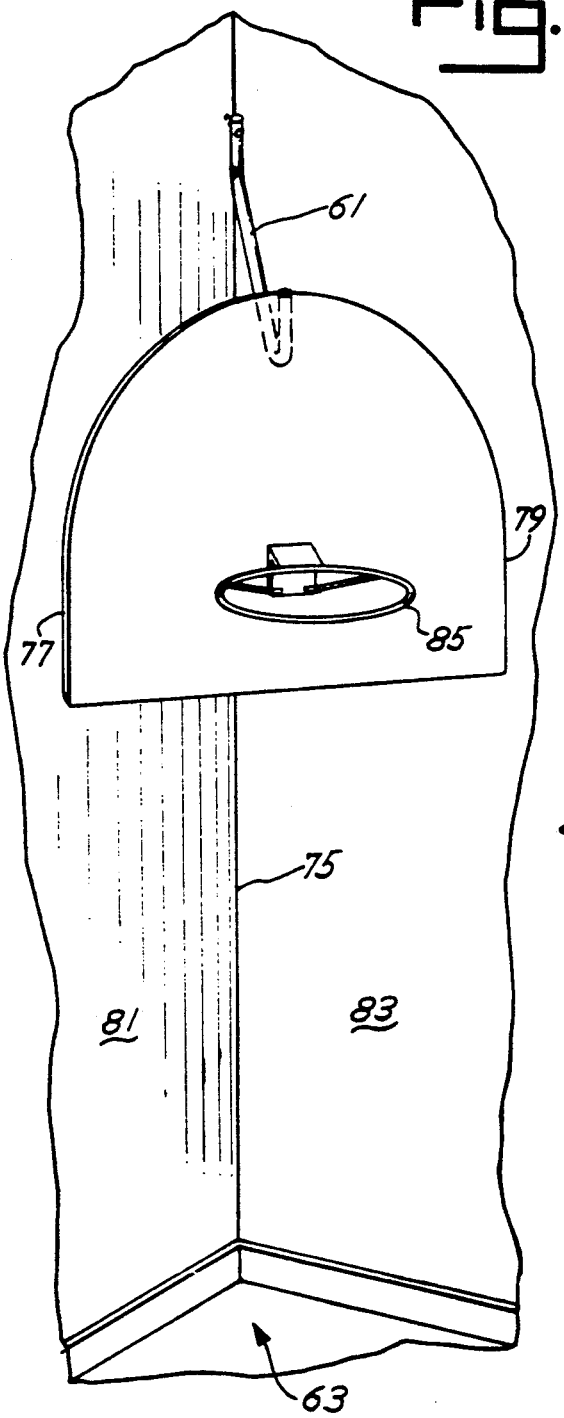
Fig.5
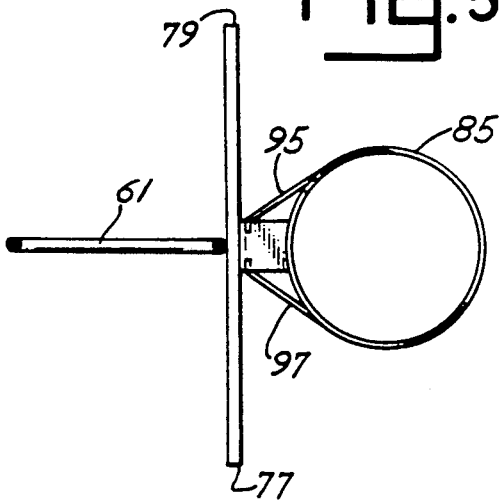
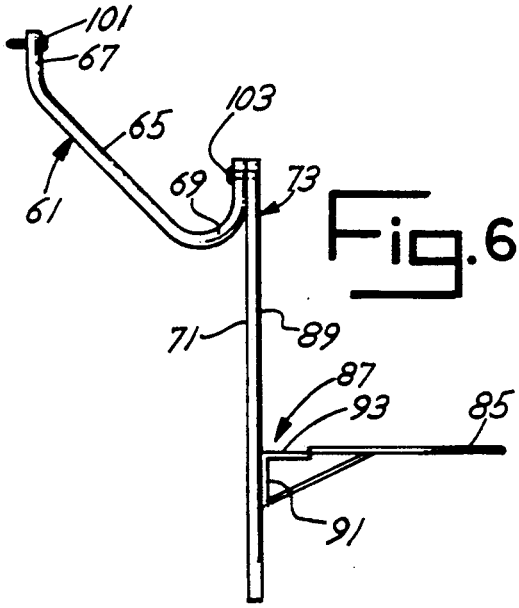
Fig.6

BASKETBALL HOOP STRUCTURE

BACKGROUND OF THE INVENTION

The present invention relates to a basketball hoop structure for use to play basketball, and more particularly, relates to the positioning of a basketball hoop and support into a particular location within a room.

Sports enthusiasts who enjoy playing basketball indoors because of adverse weather conditions, and those without access to a gymnasium, have a need for a basketball support device which can fit within a small indoor space. Other sports enthusiasts and children who do not have access to a park, driveway, or backyard also may need a basketball support device which fits in a small indoor area. If a gymnasium must be simultaneously shared by individuals performing different activities, there is also a need to solve the problem of space allocation.

In the past others have suggested numerous devices for attaching and supporting and supporting basketball rims. U.S. Pat. No. 4,657,249 (Offutt 1985) entitled "Basketball Goal Support" discloses a basketball goal support detachably secured to either the top or bottom of a door or other similar fixed structure by a U-shaped anchor, with a "J"shaped support tube. U.S. Pat. No. 4,300,764 (Burke 1981) entitled "Basketball Game with Shield" discloses a basketball hoop having a shield designed to eliminate "dunking" the ball through the hoop. U.S. Pat. No. 4,036,494 (Hayes 1977), entitled "Basketball Game Device" discloses a basketball backboard support device using telescopic poles upon which the backboard is mounted. These poles are extended between the floor and ceiling of a room and are held in place by the tension of springs in the telescopic poles.

U.S. Pat. No. 3,702,700 (Burke 1972) entitled "Basketball Backboard and Backboard Support" discloses a support device intended to extend the backboard away from the surface from which the device is attached. The rim is secured to a conventional "L-shaped" bracket. A single supporting member includes an intermediate gradually curved portion specifically designed for use on outdoor walls so that the backboard will extend from the wall thereby eliminating interference with a building's eaves.

None of the foregoing devices allow an individual to "shoot" a basketball into a goal which is securely fastened in a relatively small area within a room. It is therefore an object of the present invention is to provide a basketball goal support which can be used indoors in a relatively small area.

It is therefore an object of the present invention to provide a basketball goal support which may be secured to a corner wall area.

A further object of the present invention is to provide a basketball hoop support secured to walls or a similar structure which needs only a triangular support attached to walls converging to a corner, or a single support rod and backboard which is in rigid contact with walls converging to a corner.

SUMMARY OF THE INVENTION

These and other objects of the invention are achieved in a basketball hoop structure secured in the corner of a room.

In one embodiment, a basketball hoop support is comprised of a support attached to the converging walls of the corner of a room, and directly supporting a basketball hoop.

In another embodiment, a support structure and a backboard serve to locate and support the goal in the corner of a room.

BRIEF DESCRIPTION OF THE DRAWINGS

FIG. 1 is a front perspective view of a basketball goal embodiment of the present invention.

FIG. 2 is a top perspective view of the goal of FIG. 1.

FIG. 3 is a side view of the goal of FIG. 1.

FIG. 4 is a front perspective view of a basketball rim and backboard embodiment of the present invention.

FIG. 5 is a top perspective view of the rim and backboard of FIG. 4.

FIG. 6 is a side view of the rim and backboard of FIG. 4.

DESCRIPTION OF THE PREFERRED EMBODIMENTS

Referring to FIG. 1, a basketball goal 11 is secured in the corner 13 of a room or other area formed by a first wall 15 and a second wall 17. The first wall 15 and second wall 17 are orthogonal to one another and meet at a corner line 12.

Goal 11 is formed from a support structure generally indicated by reference numeral 18 for supporting a goal rim 19. Support structure 18 includes a triangular support device 19 and four (4) support legs 21, 23, 25, 27. A net (not shown) may be positioned on rim 29 in a conventional manner.

Rim 29 is located in a plane parallel to the floor 39 and positioned adjacent walls 15, 17. During play of the game, walls 15, 17 serve as backboards from which a ball may be banked into the goal. Support structure 18 locates the center 22 (FIG. 2) of the goal rim 29 substantially within the plane 20 (FIG. 2) which bisects the right angle formed by the walls 15, 17. This right angle array of backboards formed by walls 15, 17 provides an amusing game not found with a conventional single surface backboard.

Triangular support device 19 is formed from three elongated members 31, 33, 35, which are connected together at generally curved corners, as shown in FIG. 2. Elongated members 31, 33, 35 are straight in their mid sections defining a plane 16 (FIG. 3) which is positioned parallel to floor 39 of the room. The three elongated members may be formed integral as one continuous triangular loop as shown in FIG. 2.

Elongated members 31, 33 are attached to respective walls 15, 17 and have inner ends which are curved together in the right angle of the corner 13. Elongated members 31, 33 are positioned parallel to the floor and member 35 extends across the corner 13 between members 31, 33.

Triangular support device 19 is made of any rigid strong material which may be securely fastened to the walls. In a preferred embodiment, the triangular support 19 is positioned approximately five feet from the floor, and is made of a steel rod of approximately ⅝inches in diameter.

Three J-shaped brackets 41, 43, 45 are welded to the outside of elongated members 31, 33, 35. Brackets 41, 43, 45 have a flat backside surface 44, 46, 48 which provide structural areas for securing triangular support device 19 to the corner of the room. Structural area 44 abuts against wall 15 and structural area 46 abuts against wall 17. Bracket 43 has a flat backside 48 which provides a flat structural area which wedges into corner 13 depending on the width of bracket 43. If bracket 43 is not sufficiently wide to make contact with walls 15, 17 then the side of elongated members 31, 33 closer to corner line 12 will contact against walls 15, 17 as the bracket 43 is forced into the corner.

Screws 47, 49, 51 pass through holes in brackets 41, 43, 45 and then into walls 15, 17 for firmly securing the support structure into a fixed position relative to walls 15, 17. Screw 49 is driven directly into the corner line 12 making contact with both walls 15, 17.

As will suggest itself, screws 47, 49, 51 may be driven directly through the triangular rod forming elongated members 31, 33, 35. This will avoid the need of brackets 41, 43, 45, and the outer surface of the rod will provide a surface for contact against the side walls.

As shown in FIG. 1, each support leg 21, 23, 25, 27 has a lower end securely and rigidly attached to the topside of triangular support device 19, as for example, by a weld. Leg 23 is attached to elongated member 31 of triangular support device 19 while leg 25 is attached to elongated member 33 of the triangular support device. Leg 21 is attached to the corner where elongated members 31 and 35 meet and leg 27 is attached to the corner where elongated members 33 and 35 meet.

The upper ends of support legs 21, 23, 25, 27 are rigidly and securely attached to basketball goal rim 29. As will suggest itself, legs 21–27 may be attached to the triangular support and basketball rim at different angles, and more than four legs may be used to support rim 29 relative to triangular support device 19.

As will suggest itself, there can be varying distances between the triangular support 19 and the basketball rim 29, so long as rim 29 is parallel to floor 39. In the preferred embodiment, the basketball rim 29 is approximately 8 inches in diameter. Rim 29 is supported above the plane of the triangular support 19 by approximately five inches and is located approximately 3 inches from each of walls 15, 17.

As depicted in FIGS. 4, 5 and 6, an inverted J-shaped rod 61 is secured directly into the corner 63 of a room. As shown in FIG. 6, the inverted J-shaped rod 61 has a long straight portion 65, a tail portion 67, formed at an angle to straight portion 61, and a short curved portion 69. Also, as shown in FIG. 6, short curved portion 69 is secured at its end to the posterior surface 71 of a backboard 73. Tail portion 67 is also secured at its end to the corner line 75 of the room.

As shown in FIG. 4, backboard 73 has two side edges 77, 79 which engage first and second walls 81, 83 of the room which converge to form the corner 63. The two side edges 77, 79 are in direct contact with each wall 81, 83 respectively, when the rod 61 is secured to the corner line 75 of corner 63. The rigid contact of the backboard 73 by its two side edges 77 and 79 with each wall 81 and 83 supports and maintains the basketball rim 85 above the floor. This rigid contact also serves to wedgingly secure the edges 77, 79 against the first and second walls 81, 83 as J-shaped rod 61 forces the backboard 73 into the corner. As will suggest itself, side edges 77, 79 may be beveled or shaped to provide wedge contact against the walls 81, 83.

As seen in FIGS. 5 and 6, a supporting bracket 87 is attached to the anterior surface 89 of the backboard. Bracket 87 has a pair of linear segments 91, 93 integrally connected and positioned at right angles to one another. Segment 91 is rigidly attached to the anterior surface 89 of backboard 73 along its entire length and extends downwardly until it ends in a base. Segment 93 extends orthogonally outward from the anterior surface 89 of backboard 73. Segment 93 has a far edge which supports basketball hoop 85.

Again referring to FIG. 5, basketball hoop 85 is also attached to rigid and straight supports 95, 97, each of which has a proximal and distal end. The proximal ends of supports 95, 97 attach to the opposite sides of the base of segment 91 of supporting bracket 87. Each support 95, 97 then diverges from the base of segment 91 and extends outwardly from the anterior surface 89 of backboard 73 so that the distal ends rigidly attach to and support basketball hoop 85. As depicted in FIG. 6, supports 95, 97 approach basketball hoop 85 from the base of segment 91 at an acute angle.

As will suggest itself, the inverted J-shaped rod 61 can be fastened to the wall and backboard in a variety of ways, including conventional means such as screws and bolts, weldments, brackets, etc. In addition, rod 61 may take on shapes other than a J-shape or may be replaced by other supporting structure which connects to at least one of the two walls 81, 83 for holding the backboard tightly into the corner 63. As depicted in FIG. 6, in the preferred embodiment both portions 67, 69 are each attached by screws 101, 103.

It is to be understood, of course, that the foregoing describes preferred embodiments of the present invention, and that modifications may be made therein without departing from the spirit or scope of the present invention as set forth in the appended claims.

What is claimed is:

1. A basket ball hoop structure mountable in the corner of a room having first and second walls which are disposed orthogonal to one another and meet at a corner line, comprising:

(a) a circular rim;

(b) a support structure connected to said rim for securing said rim in the corner of the room in a plane parallel to the first of the room, said support structure including first securement means for providing a first structural area for securement against the first wall of the room and second securement means for providing a second structural area for securement against the second wall of the room, said support structure including a plurality of individual support legs and a support device, each of said support legs having a first end connected to said rim and a second end connected to said support device, said support device including said first securement means which is formed to include a bracket, and wherein first structural area is the backside of said bracket, said support device being a triangular shaped member comprising three elongated members.

2. A basketball hoop structure according to claim 1, wherein said support structure includes third securement means for securement into the corner line of the room.

3. A basketball hoop structure according to claim 1 wherein said support structure includes third securement means for providing a third structural area for securement into the corner formed by the first and second wall.

4. A corner basketball hoop support comprising:

(a) an inverted J-shaped rod, said rod having a shorter curved portion and a longer straight portion, said longer straight portion being rigidly attached into the corner of a room with converging walls, and said shorter curved portion extending out from said corner;

(b) a rigid backboard with first and second outer edges and an anterior surface and a posterior surface, said first and second outer edges wedged securely against said converging walls for support, and said shorter curved portion of said inverted J-shaped rod secured to the posterior surface of said backboard;

(c) a bracket having a vertical segment with a base and a horizontal segment with a distal end at a right angle to and positioned above said vertical segment, said vertical segment being rigidly and continuously attached to said anterior surface of said backboard, said horizontal segment extending outwardly from said anterior surface, and said distal end of said horizontal segment positioned to support a basketball rim;

(d) a pair of straight and rigid support members, each with an upper and lower end, said lower ends rigidly attached to base of said bracket, said support members extending upward; and (e) a basketball hoop rigidly connected to said bracket and said supporting members.

* * * * *